US006296724B1

(12) United States Patent
Blomquist

(10) Patent No.: US 6,296,724 B1
(45) Date of Patent: Oct. 2, 2001

(54) GAS GENERATING COMPOSITION FOR AN INFLATABLE VEHICLE OCCUPANT PROTECTION DEVICE

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/119,694

(22) Filed: Jul. 21, 1998

(51) Int. Cl.[7] ..... C06B 45/10; C06B 31/32
(52) U.S. Cl. ..... 149/47; 149/19.1; 149/46
(58) Field of Search ..... 149/47, 46, 19.1

(56) References Cited

U.S. PATENT DOCUMENTS

| | | | | |
|---|---|---|---|---|
| 3,348,985 | | 10/1967 | Stadler et al. . | |
| 3,954,528 | | 5/1976 | Chang et al. . | |
| 4,632,714 | * | 12/1986 | Abegg et al. | 149/2 |
| 5,507,891 | * | 4/1996 | Zeigler | 149/47 |
| 5,525,171 | * | 6/1996 | Finck et al. | 149/19.6 |
| 5,531,941 | | 7/1996 | Poole . | |
| 5,545,272 | | 8/1996 | Poole et al. . | |
| 5,551,725 | * | 9/1996 | Ludwig | 280/737 |
| 5,641,938 | | 6/1997 | Holland et al. . | |
| 5,780,768 | * | 7/1998 | Knowlton et al. | 149/36 |
| 5,866,842 | * | 2/1999 | Wilson et al. | 149/46 |
| 5,872,329 | * | 2/1999 | Burns et al. | 149/47 |
| 5,962,808 | * | 10/1999 | Lundstrom | 149/19.1 |

FOREIGN PATENT DOCUMENTS 9804507 2/1998 (WO) .

* cited by examiner

*Primary Examiner*—Edward A. Miller
(74) *Attorney, Agent, or Firm*—Tarolli, Sundheim, Covell, Tummino & Szabo L.L.P.

(57) ABSTRACT

An apparatus comprises an inflatable vehicle occupant protection device (20) and a gas generating composition (16). The gas generating composition (16), when ignited, produces gas to inflate the inflatable vehicle occupant protection device (20). The gas generating composition (16) comprises phase stabilized ammonium nitrate (PSAN) and an organic fuel. The organic fuel comprises nitroguanidine (NQ) and a supplemental, non-salt fuel selected from the group consisting of 3-nitro-1,2,4-triazole-5-one (NTO) and cyclotetramethylenetetranitramine (HMX).

6 Claims, 1 Drawing Sheet

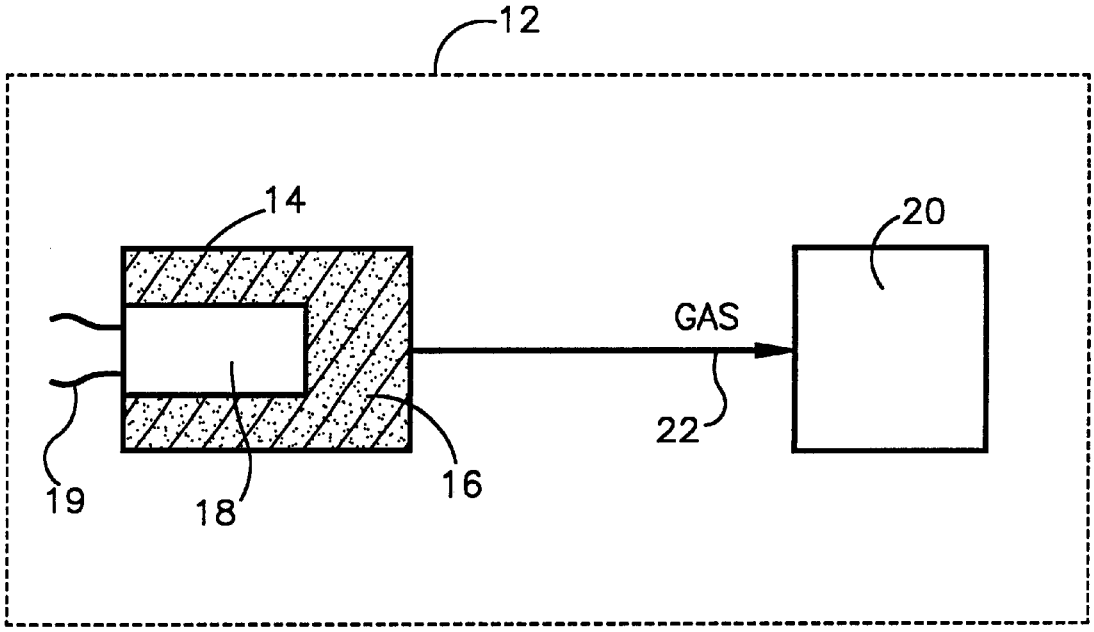
12
14
20
GAS
22
19
18
16

GAS GENERATING COMPOSITION FOR AN INFLATABLE VEHICLE OCCUPANT PROTECTION DEVICE

FIELD OF THE INVENTION

The present invention relates to an apparatus comprising an inflatable vehicle occupant protection device and a gas generating composition for providing inflation gas for inflating the inflatable vehicle occupant protection device.

BACKGROUND OF THE INVENTION

An inflatable vehicle occupant protection device, such as an air bag, is inflated by inflation gas provided by an inflator. The inflator contains a body of ignitable gas generating material. The inflator further includes an igniter. The igniter is actuated to ignite the body of gas generating material when the vehicle experiences a collision for which inflation of the air bag is desired. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

Gas generating compositions which include an organic fuel and ammonium nitrate as an oxidizer potentially provide a substantially smoke-free inflation gas that is substantially free of toxic materials. The organic fuel and ammonium nitrate are usually in the form of powders which are formed into a body of gas generating material having a discrete shape.

Motor vehicles may remain in service for many years and are subject to temperature extremes. Components of motor vehicles such as inflatable vehicle occupant protection devices undergo rigorous testing including temperature cycling from about −40° C. to above 100° C. When exposed to such temperature changes, ammonium nitrate can undergo phase changes and corresponding volumetric changes. The volumetric changes of the ammonium nitrate can adversely affect the integrity of the body of gas generating material, in turn adversely affecting the performance characteristics of the gas generating material during combustion. Furthermore, compositions containing large amounts of ammonium nitrate are difficult to ignite and prone to extinguishment.

The phase stabilization of ammonium nitrate is known to minimize the volumetric changes in ammonium nitrate due to temperature changes. One common method of phase stabilization is to dope the ammonium nitrate with a metal salt, such as potassium nitrate, in order to incorporate a metal ion such as potassium into the crystal lattice of the ammonium nitrate. This method of phase stabilization is only effective where rigorous exclusion of moisture is observed.

The above disadvantages of using ammonium nitrate as an oxidizer in a gas generating composition for inflating an inflatable vehicle occupant protection device can be reduced by minimizing the amount of ammonium nitrate in the gas generating composition. Nonetheless, it is desirable to achieve essentially complete combustion of the carbon atoms in the organic fuel to carbon dioxide rather than incomplete combustion to carbon monoxide as well as complete combustion of the hydrogen atoms in the organic fuel to water.

One approach to minimizing the amount of ammonium nitrate is to carefully select a fuel with a favorable oxygen content. With most organic fuels, at least about 60% by weight of the ammonium nitrate oxidizer, whether pure or phase stabilized, and more often, up to about 85% or more is required.

U.S. Pat. No. 5,545,272 discloses a gas generating composition which consists essentially of about 45% to about 65% phase stabilized ammonium nitrate (PSAN) and about 35% to about 55% nitroguanidine (NQ). Selection of nitroguanidine is beneficial since it is not a salt. Fuels which are salts are prone to complex phase equilibria in the presence of ammonium nitrate. Many form eutectics which are low melting, making them unsuitable for automotive applications.

SUMMARY OF THE INVENTION

The present invention resides in an apparatus comprising an inflatable vehicle occupant protection device and a gas generating composition for providing inflation gas for inflating the inflatable vehicle occupant protection device. The gas generating composition comprises an oxidizer and an organic fuel. The oxidizer is phase stabilized ammonium nitrate (PSAN). The organic fuel is a mixture of nitroguanidine (NQ) and a supplemental, non-salt fuel selected from the group consisting of 3-nitro-1,2,4-triazole-5-one (NTO) and cyclotetramethylenetetranitramine (HMX). The gas generating composition preferably also comprises up to about 10% by weight of a binder.

Preferably, the gas generating composition is oxygen balanced for substantially complete combustion of carbon in the organic fuel to carbon dioxide and hydrogen in the organic fuel to water while minimizing the formation of oxides of nitrogen.

In one embodiment of the present invention the gas generating composition consists essentially of phase stabilized ammonium nitrate (PSAN), nitroguanidine (NQ), 3-nitro-1,2,4-triazole-5-one (NTO) and up to about 10% of a binder based on the weight of the gas generating composition. The nitroguanidine and 3-nitro-1,2,4-triazole-5-one are present in approximately equal weight proportions. The weight ratio of the organic fuel to phase stabilized ammonium nitrate is preferably about 45:55 for substantially complete combustion of carbon in the organic fuel to carbon dioxide and hydrogen in the organic fuel to water while minimizing the formation of oxides of nitrogen.

In a second embodiment of the present invention, the gas generating composition consists essentially of phase stabilized ammonium nitrate (PSAN), nitroguanidine (NQ), cyclotetramethylenetetranitramine (HMX) and up to about 10% of a binder based on the weight of the gas generating composition. The nitroguanidine and cyclotetramethylenetetranitramine are present in approximately equal weight proportions. The ratio of the organic fuel to phase stabilized ammonium nitrate is preferably about 45:55 for substantially complete combustion of carbon in the organic fuel to carbon dioxide and hydrogen in the organic fuel to water while minimizing the formation of oxides of nitrogen.

BRIEF DESCRIPTION OF THE DRAWINGS

Further features of the present invention will become apparent to those skilled in the art to which the present invention relates, from consideration of the following specification, with reference to the accompanying drawing which is a schematic illustration of an apparatus embodying the present invention.

DESCRIPTION OF PREFERRED EMBODIMENTS

Referring to the FIGURE, an apparatus 12 embodying the present invention comprises an inflator 14. The inflator 14 contains a gas generating material 16 and optionally a stored gas. The gas generating material 16 is ignited by an igniter 18 operatively associated with the gas generating material 16. Electric leads 19 convey current to the igniter 18 from a sensor which is responsive to a collision. The apparatus 12 also comprises a vehicle occupant protection device 20. A gas flow means 22 conveys gas, which is generated by combustion of the gas generating material 16 in the inflator 14, to the vehicle occupant protection device 20. It is further contemplated that one or more of these inflator components may be present in duplicate for optimal occupant protection.

A preferred vehicle occupant protection device 20 is an air bag which is inflatable to protect a vehicle occupant in the event of a collision. Other vehicle occupant protection devices which can be used in the present invention are inflatable seat belts, inflatable knee bolsters, inflatable air bags to operate knee bolsters, inflatable head liners, and/or inflatable side curtains.

The gas generating composition of the present invention comprises an oxidizer and an organic fuel.

The oxidizer is phase stabilized ammonium nitrate (PSAN). The weight percent of the phase stabilized ammonium nitrate in the gas generating composition is from about 53% to about 57%, based on the combined weight of the phase stabilized ammonium nitrate and the organic fuel. Preferably, the weight percent of the phase stabilized ammonium nitrate in the gas generating composition is less than about 57%, and most preferably about 55%, based on the combined weight the phase stabilized ammonium nitrate and the organic fuel.

By the use of ammonium nitrate as the oxidizer, a relatively smoke free combustion gas product is obtained compared with other oxidizers such as perchlorates. The products of combustion of the organic fuel and ammonium nitrate are primarily carbon dioxide, nitrogen, and water.

A preferred phase stabilizer for the ammonium nitrate is one which yields a minimum quantity of smoke during combustion wherein the smoke is non-toxic or not present at harmful levels. The stabilization of ammonium nitrate is necessary to avoid volumetric and structural changes associated with the phase transitions due to the exposure of the gas generating composition to ambient temperature changes. Known phase stabilizers for ammonium nitrate include alkali metal or alkaline earth metal salts. Examples of alkali metal or alkaline earth metal salts which may be used as phase stabilizers include nitrates, nitrites, peroxides, dinitramides, dichromates, and oxalates. A commonly used phase stabilizer is potassium nitrate ($KNO_3$). The amount of phase stabilizer is an effective amount to stabilize ammonium nitrate and is up to about 15% based upon the weight of ammonium nitrate.

Ammonium nitrate can also be stabilized by doping with copper and zinc ions. Other compounds, modifiers, and methods that are effective to phase stabilize ammonium nitrate are well known and suitable in the present invention.

The gas generating composition of the present invention comprises an organic fuel. In accordance with the present invention, the organic fuel is a combination of organic fuels. One of the fuels is nitroguanidine (NQ). The second is a supplemental, non-salt fuel, compatible in the composition, selected from the group consisting of 3-nitro-1,2,4-triazole-5-one (NTO) and cyclotetramethylenetetranitramine (HMX). Both supplemental, non-salt fuels, 3-nitro-1,2,4-triazole-5-one and cyclotetramethylenetetranitramine, contain a substantial amount of oxygen atoms, more than in nitroguanidine. The supplemental, non-salt fuels thus improve the oxygen balance in the gas generating composition and reduce the amount of oxidizer required for an oxygen balance, as compared to using nitroguanidine alone. Preferably, the weight ratio of the nitroguanidine to the supplemental, non-salt fuel is from about 35:65 to about 65:35, most preferably about 1:1.

The amount of the organic fuel in the gas generating composition is that amount necessary to achieve sustained combustion of the gas generating composition. The amount can vary depending upon the particular organic fuel used and other reactants.

The weight ratio of the organic fuel to the oxidizer is that weight ratio which is effective to provide a combustion gas product which is substantially free of gases hydrogen, carbon monoxide, and oxides of nitrogen.

The gas generating composition of the present invention can also comprise an elastomeric binder. Suitable binders for gas generating compositions are well known in the art. Preferred binders include polycarbonates, polyurethanes, polyesters, polyethers, polysuccinates, thermoplastic rubbers, polybutadiene, polystyrene, and mixtures thereof.

A preferred amount of binder is in the range of 0 to about 15%, preferably about 2.5% to about 10%, based on the weight of the gas generating composition.

The present invention can comprise other ingredients commonly added to a gas generating composition for providing inflation gas for inflating an inflatable vehicle occupant protection device. Such other ingredients might include process aids, combustion modifiers, coolants, and ignition aids. A plasticizer may also be used, but preferably the gas generating composition does not include a plasticizer.

EXAMPLE 1

A quantity of phase stabilized ammonium nitrate was prepared by co-crystallizing ammonium nitrate with 15 weight percent potassium nitrate (based on the weight of ammonium nitrate) from an aqueous solution. After drying, the solids were ball milled to reduce particle size, thereby producing a fine granular material.

A gas generating mixture consisting of nitroguanidine (NQ) powder, 3-nitro-1,2,4-triazole-5-one (NTO) and phase stabilized ammonium nitrate (PSAN) powder, in the weight ratio of about 22.5:22.5:55 respectively, was prepared by ball milling the powders to mix the powders and reduce particle size. Pellets were formed by compression molding the powder to form grains of approximately 12.7 mm (0.5 inch) diameter by 12.7 mm length with a mass of 3 grams. The pellets were compression molded at approximately 296 MPa (43,000 psi).

The calculated combustion temperature of the mixture is 2409° C. The burning rate of the pellets was measured and found to be 8.6 mm (0.34 inch) per second at 6.9 MPa (1000 psi) with a pressure exponent of 0.47. Residue in the amount of about 8% potassium bicarbonate ($KHCO_3$), based on the weight of the gas generating mixture, was produced.

EXAMPLE 2

A mixture consisting of nitroguanidine (NQ) powder, cyclotetramethylenetetranitramine (HMX) powder, and the phase stabilized ammonium nitrate powder (PSAN) of Example 1, in the weight ratio of about 23:23:54, was prepared by ball milling the powders to mix the powders and reduce particle size, as in Example 1. Pellets were formed by compression molding the powder mix to form grains using the same procedure of Example 1.

The calculated combustion temperature of the mixture is 2409° C. The burning rate of the pellets was measured and found to be 8.6 mm (0.34 inch) per second at 6.9 MPa (1000 psi) with a pressure exponent of 0.47. Residue in the amount of less than 8% potassium bicarbonate ($KHCO_3$), based on the weight of the gas generating mixture, was produced.

Control Example 1

A mixture of nitroguanidine (NQ) and the phase stabilized ammonium nitrate powder of Example 1, in the weight ratio of about 40:60, was prepared by ball milling the powders to mix the powders and reduce particle size, as in Example 1. Pellets were formed by compression molding the powder to form grains using the procedure of Example 1.

The calculated combustion temperature of the mixture is 2409° C. The burning rate of the pellets was measured and found to be 8.6 mm (0.34 inch) per second at 6.9 MPa (1000 psi) with a pressure exponent of 0.47. Residue in the amount of about 8.5% potassium bicarbonate ($KHCO_3$), based on the weight of the gas generating mixture, was produced.

Advantages of the present invention should be apparent. Primarily, the present invention takes advantage of the favorable performance characteristics of using an organic fuel, comprising nitroguanidine (NQ) and a supplemental, non-salt fuel, and phase stabilized ammonium nitrate (PSAN) as an oxidizer in a gas generating composition for providing inflation gas for inflating an inflatable vehicle occupant protection device. The supplemental, non-salt fuel in the present invention is selected from the group consisting essentially of 3-nitro-1,2,4-triazole-5-one (NTO) and cyclotetramethylenetetranitramine (HMX). A mixture of the oxidizer and the organic fuel offers good mechanical stability without sacrificing burning performance. Furthermore, the gas generating composition of the present invention produces a clean gas product which is essentially non-toxic and free of particulates. The mechanical stability and quality of the gas product accrue from the use of a reduced amount of oxidizer due to the presence of the supplemental, non-salt fuel which contains more oxygen atoms than nitroguanidine.

From the above description of the invention, those skilled in the art will perceive improvements, changes and modifications. Such improvements, changes and modifications within the skill of the art are intended to be covered by the appended claims.

Having described the invention, the following is claimed:

1. An apparatus comprising:

an inflatable vehicle occupant protection device; and a gas generating composition which when ignited produces gas to inflate said inflatable vehicle occupant protection device, said gas generating composition consisting essentially of phase stabilized ammonium nitrate, an organic fuel, and up to about 10% by weight, based on the weight of the gas generating composition, of a binder, wherein said organic fuel consists essentially of nitroguanidine (NQ) and a supplemental, non-salt fuel selected from the group consisting of 3-nitro-1,2,4-triazole-5-one (NTO) and cyclotetramethylenetetranitramine (HMX), the weight ratio of said nitroguanidine to said supplemental non-salt fuel being in the range of about 35:65 to about 65:35, and wherein the gas generating composition is oxygen balanced for substantially complete combustion of carbon in the organic fuel to carbon dioxide and hydrogen in the organic fuel to water while minimizing the formation of oxides of nitrogen.

2. The apparatus as defined in claim 1, wherein the weight percent of said phase stabilized ammonium nitrate in said gas generating composition is from about 53% to about 57%, based on the combined weight of said phase stabilized ammonium nitrate and said organic fuel.

3. The apparatus as defined in claim 2 wherein the weight percent of said phase stabilized ammonium nitrate in said gas generating composition is about 55%, based on the combined weight of said phase stabilized ammonium and said organic fuel.

4. The apparatus as defined in claim 1 wherein the weight ratio of said nitroguanidine to said supplemental, non-salt fuel is 1:1.

5. The apparatus as defined in claim 1 wherein said organic fuel consists essentially of nitroguanidine and 3-nitro-1,2,4-triazole-5-one (NTO).

6. The apparatus as defined in claim 1 wherein said organic fuel consist essentially of nitroguanidine (NQ) and cyclotetramethylenetetranitramine (HMX).

* * * * *